US012778241B2

(12) United States Patent
Rankin

(10) Patent No.: US 12,778,241 B2
(45) Date of Patent: Nov. 3, 2026

(54) LACE POCKETS

(71) Applicant: James Terrell Rankin, Henderson, NV (US)

(72) Inventor: James Terrell Rankin, Henderson, NV (US)

( * ) Notice: Subject to any disclaimer, the term of this patent is extended or adjusted under 35 U.S.C. 154(b) by 23 days.

(21) Appl. No.: 18/966,351

(22) Filed: Dec. 3, 2024

(65) Prior Publication Data

US 2025/0089851 A1 Mar. 20, 2025

(51) Int. Cl.
*A43C 7/02* (2006.01)

(52) U.S. Cl.
CPC ..... *A43C 7/02* (2013.01); *Y10T 24/3705* (2015.01)

(58) Field of Classification Search
CPC .... A43C 7/02; A43C 7/00; A43C 9/02; A43C 11/24; Y10T 24/3705; A43B 1/0081
See application file for complete search history.

(56) References Cited

U.S. PATENT DOCUMENTS 559,206 A * 4/1896 Pine ..... A43C 7/00 24/712.9
667,939 A * 2/1901 Frye ..... A43C 7/00 24/712.9
791,482 A * 6/1905 Means ..... A43C 7/00 24/712.2
805,275 A * 11/1905 Fisher ..... A43C 7/00 24/712.2
948,460 A * 2/1910 Partridge ..... A43C 7/04 24/712.2
1,055,048 A * 3/1913 Kennedy ..... A43C 7/00 24/712.2
2,430,463 A * 11/1947 Gilbert ..... C14B 11/00 38/56
5,158,428 A * 10/1992 Gessner ..... F16G 11/103 24/712.9
5,746,500 A * 5/1998 Chien ..... A43B 1/0036 36/137
7,596,838 B1 * 10/2009 Bulmer ..... A43C 7/00 24/712.9
8,888,346 B2 * 11/2014 Tseng ..... A43C 9/00 362/570
2008/0110004 A1 * 5/2008 Franzino ..... A43C 7/005 24/712.2
2010/0115744 A1 * 5/2010 Fong ..... A43C 7/00 24/712.1
2012/0222271 A1 * 9/2012 Lai ..... A43C 1/00 24/306
2013/0255038 A1 * 10/2013 Lai ..... A43C 11/24 24/304
2015/0040360 A1 * 2/2015 Manganaro ..... A43C 7/04 24/712.6
2018/0110297 A1 * 4/2018 Rankin ..... A43C 11/1406
2019/0125033 A1 * 5/2019 Smith ..... A43C 7/005
2019/0343233 A1 * 11/2019 Rankin ..... A43B 3/34

* cited by examiner

*Primary Examiner* — David M Upchurch
(74) *Attorney, Agent, or Firm* — Weiss & Moy, PC; Jeffrey D. Moy

(57) ABSTRACT

A shoe lace securement system has a pair of shoe lace securing mechanisms. Each of the pair of shoe lace securing mechanisms has a container having a hollow interior storing unused portions of the shoe lace. A mechanism secures one end of the shoe lace to the container. A first connector is coupled to a bottom surface of the container attaching the container to the shoe.

8 Claims, 3 Drawing Sheets

LACE POCKETS

RELATED APPLICATIONS

The present application is related to U.S. Pat. No. 11,395,527, entitled No Bow Lace Loopers, issued on Jul. 26, 2022, in the name of James Rankin, which is related to U.S. Pat. No. 10,575,590, entitled "No Bow Lace Loopers, issued on Mar. 3, 2020 in the name of James Rankin both of which are incorporated herein by reference in its entirety.

This patent application is further related to U.S. Provisional Application No. 63/452,816 filed Mar. 17, 2023, entitled "Lace Pockets" in the name James Rankin, and U.S. Provisional Application No. 63/453,628 filed Mar. 21, 2023, entitled "Lace Pockets" in the name James Rankin and both which are incorporated herein by reference in its entirety.

TECHNICAL FIELD

The present invention is generally directed to the field of shoe laces and, in particular, to a device and process whereby shoe laces can be easily secured by an operator or user to provide consistent shoe lace tension and excess sections of the shoe lace can be stored within a device secured to a shoe. The device may provide an ornamental feature highly desired in contemporary footwear.

BACKGROUND

Most conventional shoes are formed with a plurality of reinforced apertures which extend longitudinally on both sides of the center of the upper from the vamp up to the ankle of the shoe. The apertures are located on the facing edges of the shoe upper directly over the tongue of the shoe. A shoelace is then laced through the apertures. The free ends of the shoelace are typically encased within small, rigid, cylindrical plastic tips which facilitate insertion of the shoelace ends through the apertures. The ends of the shoelace are first passed through the apertures adjacent to the vamp and are progressively and sequentially passed through the plurality of apertures, crossing over the tongue each time from one aperture to the next from the vamp of the shoe up to the ankle. Once the free ends of the shoelace have been threaded through the uppermost eyelets at the ankle of the shoe they are normally tied together in the form of a knot or bow.

Traditional tie up shoe lace cords can be difficult to manually tie effectively, consistently and quickly. This is constraining for either children who have not learnt to tie traditional laces into bows/knots or for people with physical handicaps, arthritis or disabilities. Furthermore, lacebows/loops being positioned on the outside of the shoe can come undone or catch on something potentially causing the wearer to trip. Additionally, the bow/knots are aesthetically unappealing and especially when tied unevenly Previous devices are deficient from the point of view of a consumer with a desire to quickly, easily, and simply maintain adequate tension while securing shoe laces. Further, some current devices require a combination of mechanics to increase the tension, greatly increasing the production cost of a shoe. The present invention is based off an easily produced and simple design capable of being configured as a removable shoe accessory or incorporated into the design of a shoe.

Some examples of the variety of devices which secure or tighten shoe laces or the like can be summarized in the following. One type of machine, shown in U.S. Pat. No. 5,157,813, uses a crank driven device affixed to the tongue of a shoe to increase the tension of the laces through rotation. Laces are fed through the rotation device which is turned to increase tension. A spring operates to prevent the tension from becoming too high and causing discomfort. This prior art is a good example of a tightening mechanism, but this device is mechanically complex, difficult to produce, and aesthetically unappealing.

Other machines provide motor powered tightening. For instance, U.S. Pat. No. 7,752,774 is an automatic shoe lace tightening system. This machine is meant to be operated via a switch with a motor and spool whereby the laced wrap around the spool and increase lace tension for the user. Clearly, this machine is an expensive product that must be integrated within the shoe, preventing interchangeability between commonly available shoes and increasing maintenance costs. In contrast, the present invention can be manufactured with extremely low cost and can be placed in any shoe with laces at the consumer level or, alternatively, directly incorporated into the manufacturer's design.

Therefore, it would be desirable to provide a device and method that overcomes the above. The device is designed as an inexpensive and interchangeable customer installed shoe lace securement mechanism which does not require production level integration or expensive mechanical parts, is operable by persons unable to tie a knot, and maintains or increases aesthetic appeal.

SUMMARY

In accordance with one embodiment, a shoe lace securement system is disclosed. The shoe lace securement system has a pair of shoe lace securing mechanisms. Each of the pair of shoe lace securing mechanisms has a container having a hollow interior storing unused portions of the shoe lace. A mechanism secures one end of the shoe lace to the container. A first connector is coupled to a bottom surface of the container attaching the container to the shoe.

In accordance with one embodiment, a shoe lace securement system is disclosed. The shoe lace securement system has a pair of shoe lace securing mechanisms. Each of the pair of shoe lace securing mechanisms a container having a hollow interior storing unused portions of the shoe lace. A slit is formed in the container, wherein the unused portion of the shoe lace is inserted into the slit and into the hollow interior of the container for storage, the slit configured to secure the unused portion of the shoe lace in the hollow interior. A mechanism secures one end of the shoe lace to the container. a first connector coupled to a bottom surface of the container attaching the container to the shoe. A second connector is attached to the shoe, the first connector attaching to the second connector securing the container to the shoe.

In accordance with one embodiment, a shoe lace securement system is disclosed. The shoe lace securement system has a pair of shoe lace securing mechanisms. Each of the pair of shoe lace securing mechanisms a container having a hollow interior storing unused portions of the shoe lace. The container has a flat bottom surface and an enclosure extending from an outer perimeter of the flat bottom surface forming the hollow interior. A slit is formed in the enclosure, wherein the unused portion of the shoe lace is inserted into the slit and into the hollow interior of the container for storage, the slit configured to secure the unused portion of the shoe lace in the hollow interior. A mechanism secures one end of the shoe lace to the container, wherein the mechanism securing one end of the shoe lace to the container comprises a first opening formed through the flat bottom surface and a second opening formed through the enclosure, wherein one end of the shoe lace may be inserted into the first opening into the hollow interior and out of the second opening to secure the shoe lace to the container. A first connector is coupled to the flat bottom surface attaching the container to the shoe. A second connector is attached to the shoe, the first connector attaching to the second connector securing the container to the shoe.

This summary is not intended to identify key features or essential features of the claimed subject matter, nor is it intended to be used as an aid in determining the scope of the claimed subject matter. Additional features and advantages of exemplary implementations of the present disclosure will be set forth below, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

An embodiment of the present invention will hereinafter be described in conjunction with the appended drawings, provided to illustrate and not to limit the invention, in which.

DESCRIPTION OF THE APPLICATION

Figures 1A, 1B, 1C, 1D, 1E, 1F, 1G:
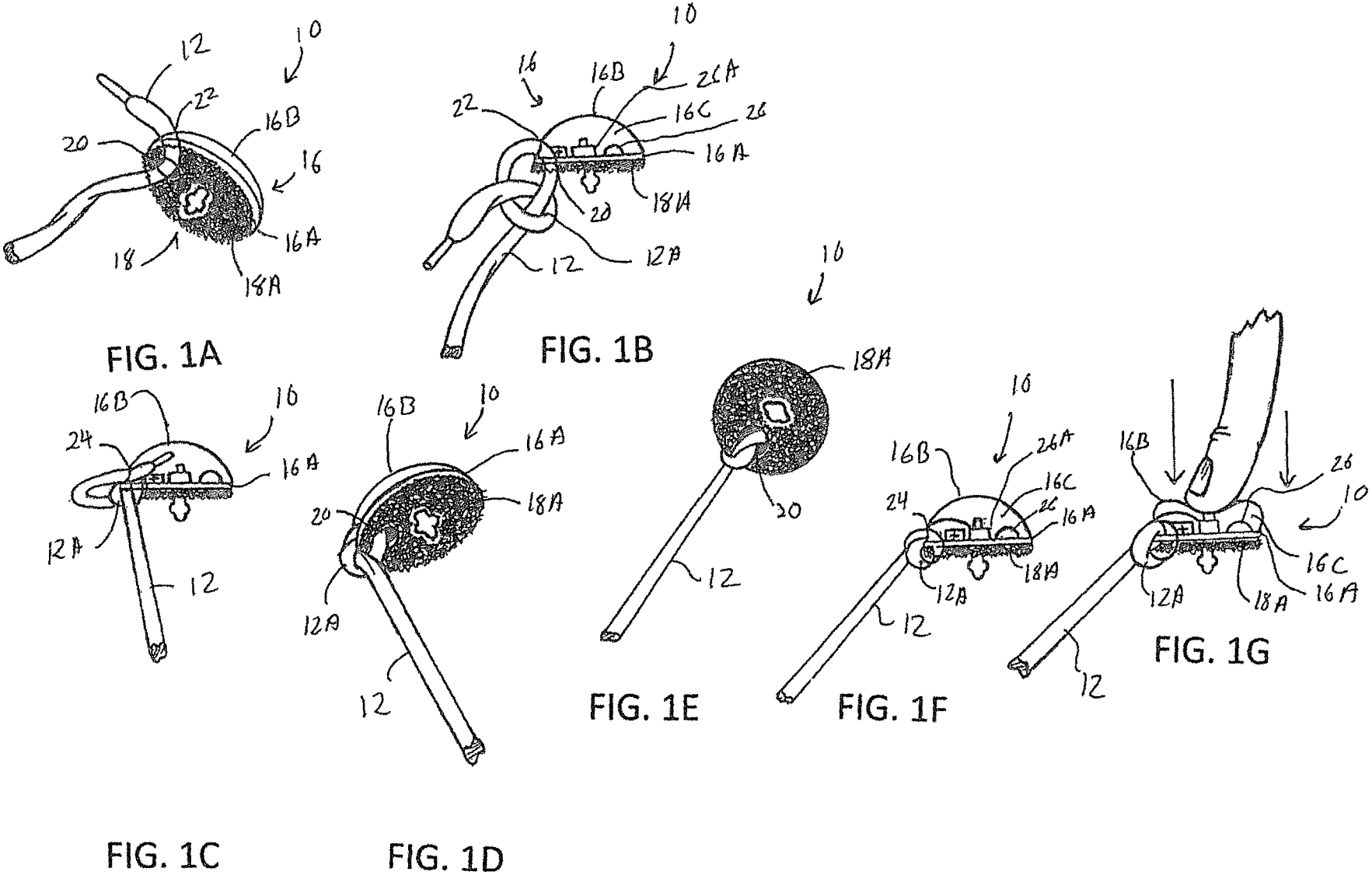
FIGS. 1A-1G are different perspective views of an exemplary embodiment of securing a shoe lace in a shoe lace pocket in accordance with one aspect of the present application.
Figure 2A:
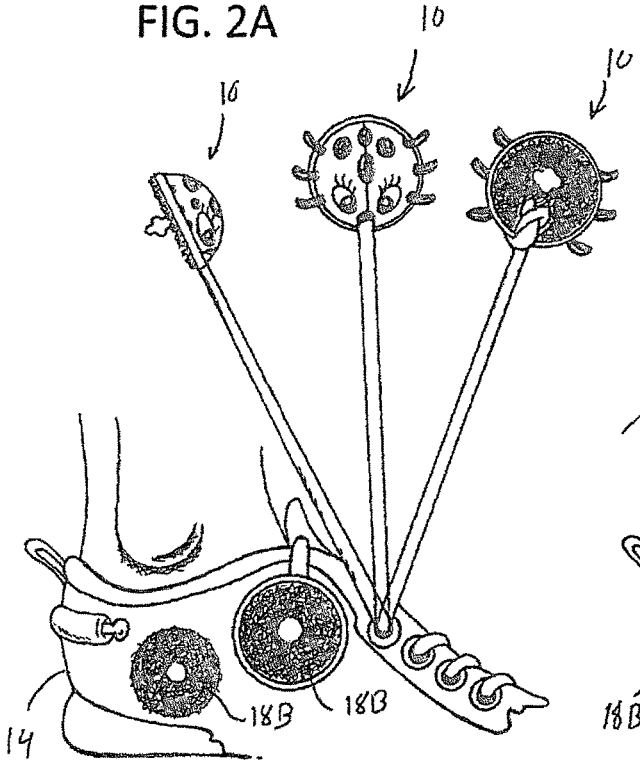
FIGS. 2A-2D are different perspective views of an exemplary embodiment of the shoe lace pocket of FIG. 1 being secured to a shoe in accordance with one aspect of the present application.
Figure 2B:
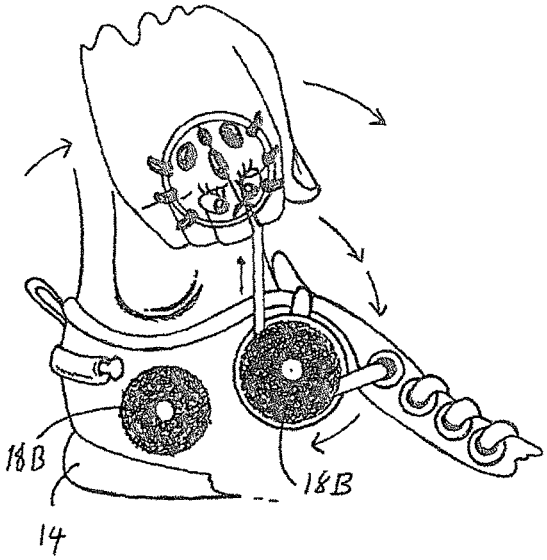
Figure 2C:
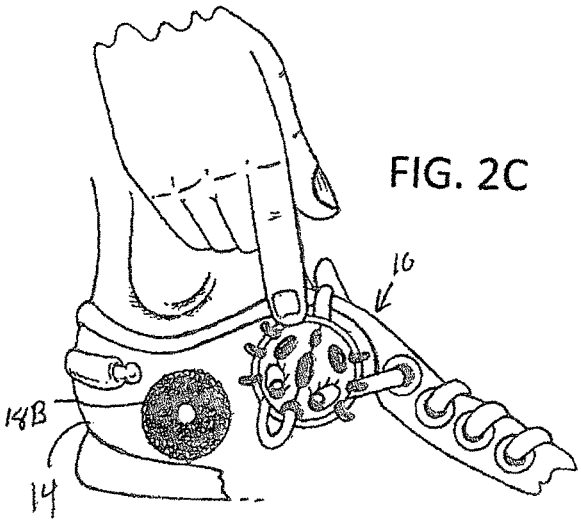
Figure 2D:
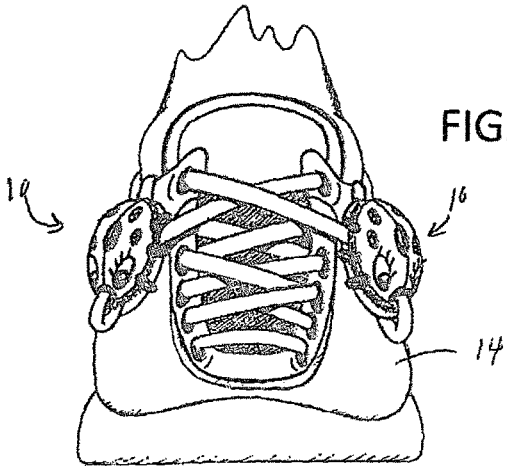
Figure 3B:
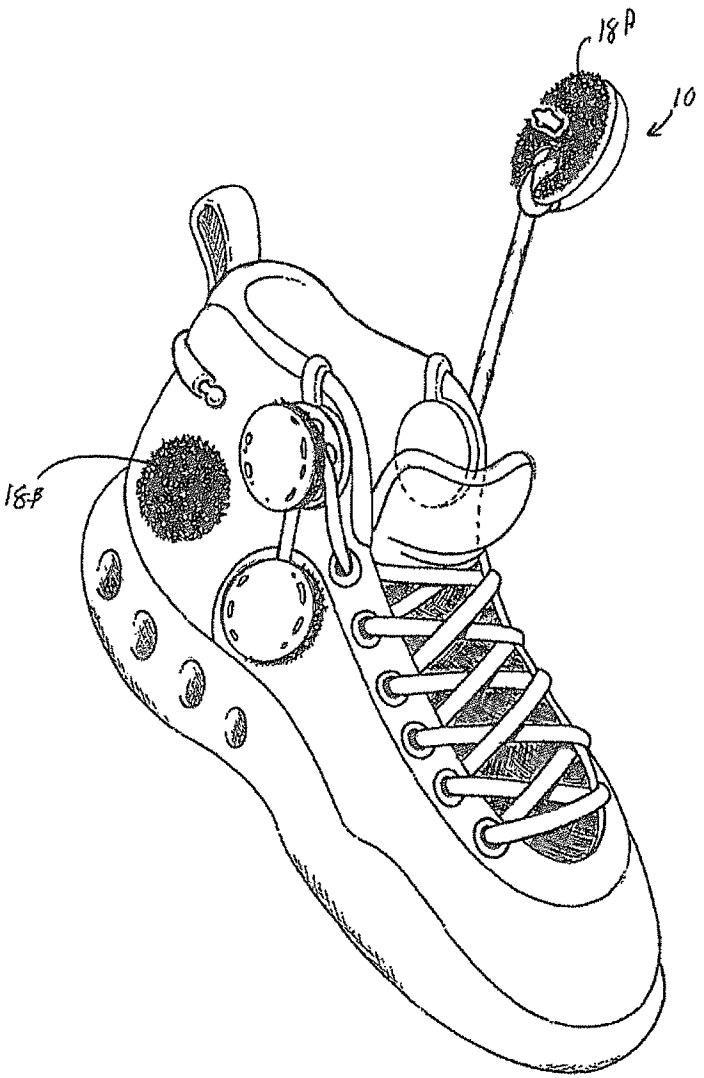
FIGS. 3A-3B are different perspective views of an exemplary embodiment of the shoe lace pocket of FIG. 1 being secured to a shoe in accordance with one aspect of the present application.
Figure 3A:
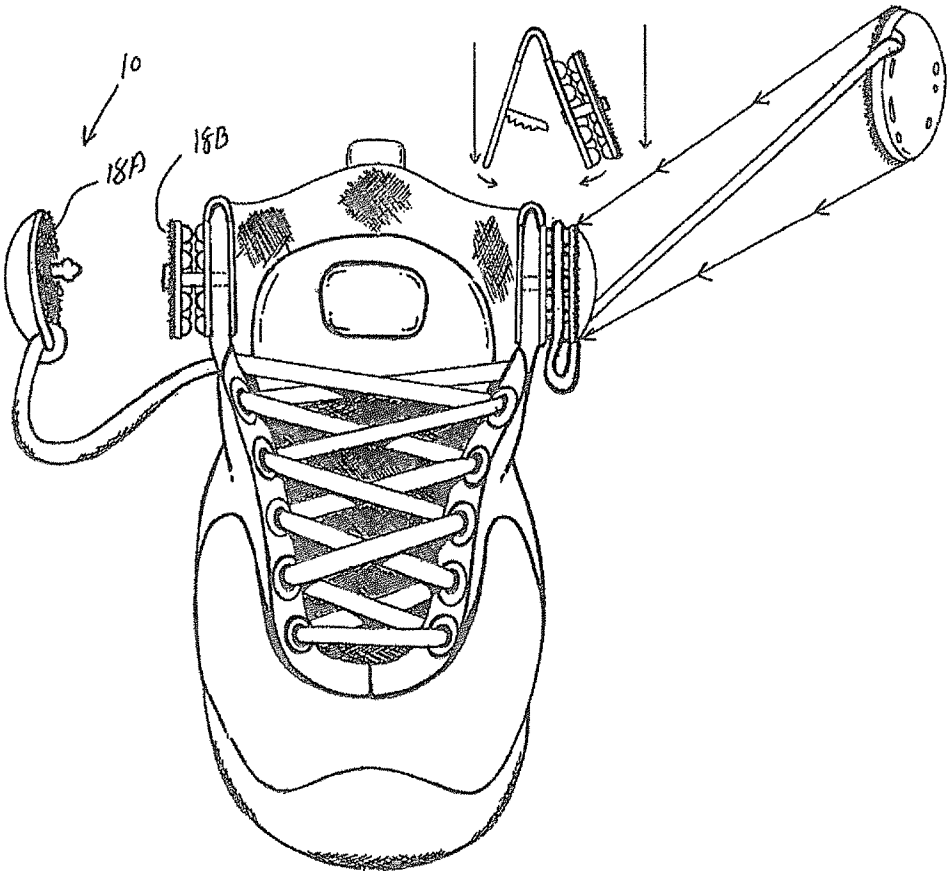

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Referring to the FIGs., a shoe lace pocket 10 (hereinafter pocket 10) may be shown. The pocket 10 may be used as a mechanism to store a portion of a shoe lace 12 there within as well as a mechanism to tighten and secure the shoe laces 12 of a shoe 14 (FIGS. 2A-3B). The pocket 10 may be formed of a container 16 having a hollow interior 16C. The container 16 may be formed of different geometrical configurations. In the present embodiment, the container 16 may be formed in a hemispherical shape. However, this is shown as one example and the container 16 may be formed in other geometrical configurations without departing from the spirit and scope of the present invention. For example, the container 16 may be shaped/molded into different characters, animals, letters, numbers, logos, symbols and the like without departing from the spirit and scope of the present invention.

The container 16 may have a flat bottom surface 16A. The flat bottom surface 16A may allow the container 16 to be attached to a surface of the shoe 14. In accordance with one embodiment, connectors 18 may be used to attached the container 16 to the surface of the shoe 14. A first connector 18A may be formed on the flat bottom surface 16A of the container 16. A corresponding connector 18B may be formed on the surface of the shoe 14. The corresponding connector 18B may be formed on any surface of the shoe 14 including the tongue of the shoe 14. Alternatively, the corresponding connector 18B may be formed on a shoe lace securing device secured to the shoe 12 similar to that disclosed in U.S. Pat. Nos. 11,395,527 and 10,575,590 thereby allowing the pocket 10 to be used with different a shoe lace securing devices. The first connector 18A may attach to the corresponding connector 18B thereby securing the pocket 10 to the shoe 14. The connectors 18 may be hook and loop material, snaps, male/female connectors, or other types of connectors 18.

The container 16 may have an enclosure 16B extending up from the outer perimeter of the flat bottom surface 16A to form the hollow interior 16C. In the present embodiment, the enclosure 16B may be semi-spherical in shape. However, this is just shown as an example and should not be seen in a limiting manner.

The container 16, and more specifically, the enclosure 16B may be formed of a semi-rigid/semi-pliable material. This may provide an enclosure 16B which may allow a user to push downward on the enclosure 16B allowing the enclosure to bend inward but return to an original shape once the downward pressure has been removed. The material used to form the enclosure 16B may further be translucent to allow light to pass through the enclosure 16B. In accordance with one embodiment, the enclosure 16B may be formed of a semi-rigid material such as different types of plastic materials like a low-density polyethylene (LDPE) or the like.

An opening 20 may be formed in the bottom surface 16A of the container 16. The opening 20 may be formed along an outer perimeter of the bottom surface 16A. The opening 20 may be sized to allow one to insert an end of the shoe lace 12 through the opening 20. An opening 22 may be formed through the enclosure 16B. The opening 22 may be towards a bottom area of the enclosure 16B. The opening 22 may also be sized to allow one to insert an end of the shoe lace 12 through the opening 22. The openings 20 and 22 may allow one to pass one end of the show lace 12 through the opening 20 and into the hollow interior 16C of the container 16, while the opening 22 may allow the end of the shoe lace 12 to exit the hollow interior 16C of the container 16. This may allow the user to create an anchor with a loop as shown in FIG. 1B. In accordance with one embodiment, both ends of the show lace 12 may be anchored to different pockets 10 as described above.

The container 16 may have a slit 24 formed therein. The slit 24 may be formed on either the bottom surface 16A of the container 16 or on the enclosure 16B. In the present embodiment, the slit 24 may be formed in the enclosure 16B. The slit 24 may be sized to allow a user to push/slide the shoe lace 12 inside the hollow interior 16C of the enclosure 16B but may prevent the shoe lace 12 from coming back out of the slit 24 thereby securing the excess shoe lace 12 inside the hollow interior 16C of the enclosure 16B. Once a respective end of the shoe lace 12 is anchored to a respective pocket 10, the user may insert any excess portion of the shoe lace 12 extending above the knot 12A through the slit 24 and into the hollow interior 16C of enclosure 16B.

One may remove the excess shoe lace 12 inside the hollow interior 16C of enclosure 16B by pressing downward on the enclosure 16B. Pressing downward on the enclosure 16B may open up the slit 24 thereby allowing the user to remove the excess shoe lace 12 inside the hollow interior 16C of the enclosure 16B.

A lighting circuit 26 may be positioned within the hollow interior 16C of the enclosure 16B. The lighting circuit 26 may allow the pocket 10 to illuminate/glow when activated. In accordance with one embodiment, the lighting circuit 26 may have an activation button 26A housed within the within the hollow interior 16C of the enclosure 16B. The activation button 26A may activate the lighting circuit 26 by pressing downward on the enclosure 16B to depress the activation button 26A a first time. Pressing downward on the enclosure 16B to depress the activation button 26A a second time may deactivate the lighting circuit 26.

In operation, the user may anchor each end of the shoe lace 12 to a respective pocket 10. This may be done by passing one end of the show lace 12 through the opening 20 and into the hollow interior 16C of the container 16 and then through the opening 22 to exit the hollow interior 16C of the container 16. This may allow the user to create an anchor with a loop knot as shown in FIG. 1B. Once a respective end of the shoe lace 12 is anchored to a respective pocket 10, the user may insert any excess portion of the shoe lace 12 extending above the knot 12A through the slit 24 and into the hollow interior 16C of enclosure 16B. The hollow interior 16C may be sized to accommodate and secure the excess shoe lace 12 inside. The slit 24 may be designed to close and secure the shoe lace 12 inside the hollow interior 16C once the shoe lace 12 is inserted therethrough. The shoe lace 12 may be removed by pressing downward on the enclosure 16B thereby opening up the size of the slit 24 allowing a user to pull the shoe lace 12 back out of the slit 24.

The user may then grasp each pocket 10 and each end of the shoe lace 12 and pull upward on the shoe laces 12 using the pockets 10 as end handles for the shoe lace 12. Once the shoe laces are tightened to a designed level, the user may then cross the shoe laces 12 through one another as in a regular motion for tying the shoe laces 12. The user may then attached each pocket 10 using the first connector 18A formed on the flat bottom surface 16A of the container 16 and attaching it to the corresponding connector 18B which may be attached on the surface of the shoe 14 or attached on a shoe lace securing device similar to that disclosed in U.S. Pat. Nos. 11,395,527 and 10,575,590.

The foregoing description is illustrative of particular embodiments of the application, but is not meant to be a limitation upon the practice thereof. The following claims, including all equivalents thereof, are intended to define the scope of the application.

What is claimed is:

1. A shoe lace securement system comprising:

a pair of shoe lace securing mechanisms, each of the pair of shoe lace securing mechanisms coupled to a same shoe, wherein each of the pair of shoe lace securing mechanisms comprises:

a container formed of a housing having a hollow interior storing unused portions of the shoe lace;

a mechanism securing one end of the shoe lace to the container;

a first connector coupled to a bottom surface of the container attaching the container to the shoe; and a lighting circuit housed within the container.

2. The shoe lace securement system of claim 1, wherein each of the pair of shoe lace securing mechanisms comprises a second connector attached to the shoe, the first connector attaching to the second connector securing the container to the shoe.

3. The shoe lace securement system of claim 1, wherein each of the pair of shoe lace securing mechanisms comprises a slit formed in the container, wherein the unused portion of the shoe lace is inserted into the slit and into the hollow interior of the container for storage.

4. The shoe lace securement system of claim 1, wherein the container comprises:

a flat bottom surface; and an enclosure extending from an outer perimeter of the flat bottom surface forming the hollow interior.

5. The shoe lace securement system of claim 4, wherein the enclosure is formed of a semi-pliable material.

6. The shoe lace securement system of claim 4, wherein the enclosure is formed of a semi-pliable and translucent material.

7. The shoe lace securement system of claim 4, wherein the mechanism securing one end of the shoe lace to the container comprises:

a first opening formed through the flat bottom surface; and a second opening formed through the enclosure;

wherein one end of the shoe lace is inserted into the first opening into the hollow interior and out of the second opening to secure the shoe lace to the container.

8. The shoe lace securement system of claim 5, comprising a push button activating and deactivating the lighting circuit, wherein pushing downward on the enclosure formed of a semi-pliable and translucent material a first time activates the lighting circuit and pushing downward on the enclosure formed of a semi-pliable and translucent material a second time deactivates the lighting circuit.

* * * * *